United States Patent [19]

Kelrick

[11] Patent Number: 4,892,284

[45] Date of Patent: Jan. 9, 1990

[54] ADJUSTABLE HANGER

[76] Inventor: Joseph Kelrick, 4230 Casper Ct., Hollywood, Fla. 33021

[21] Appl. No.: 290,267

[22] Filed: Dec. 23, 1988

[51] Int. Cl.[4] ..... A47G 1/24

[52] U.S. Cl. ..... 248/476; 248/495

[58] Field of Search ..... 248/476, 495, 498, 477, 248/480, 496, 301, 303, 304, 339

[56] References Cited

U.S. PATENT DOCUMENTS

| | | | |
|---|---|---|---|
| 2,522,901 | 9/1950 | Schrager et al. | 248/495 |
| 2,681,194 | 6/1954 | Halvorsen | 248/495 |
| 2,697,572 | 12/1954 | Pfankush | 248/495 |
| 2,723,096 | 11/1955 | Schwartz | 248/498 X |
| 3,370,822 | 2/1968 | Miller | 248/495 |
| 3,945,599 | 3/1976 | Spier et al. | 248/476 |
| 4,558,930 | 12/1985 | Deedreek | 248/480 X |
| 4,611,780 | 9/1986 | Robertson | 248/477 |
| 4,775,127 | 10/1988 | Nakamura | 248/476 X |

FOREIGN PATENT DOCUMENTS

| | | | |
|---|---|---|---|
| 2374050 | 8/1978 | France | 248/339 |
| 577343 | 5/1946 | United Kingdom | 248/495 |

*Primary Examiner*—Ramon O. Ramirez

*Attorney, Agent, or Firm*—Berman, Aisenberg & Platt

[57] ABSTRACT

A device for adjusting the position of an object hanging on a wall includes a rack and pinion for continuously moving the object horizontally and a threaded screw for continuously moving the object vertically. The object is carried on a hook attached to the vertically adjustable threaded rod and the threaded rod is engaged with a carrier adjustably riding on the horizontal rack. The object being supported by the device may be moved continuously in either the horizontal or vertical direction from a remote position by adjusting with an elongated tool.

15 Claims, 1 Drawing Sheet

FIG. 1
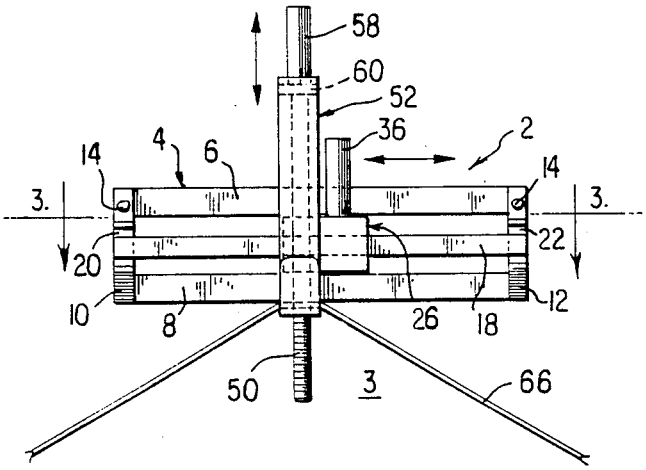
FIG. 2
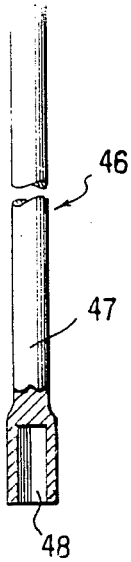
FIG. 3
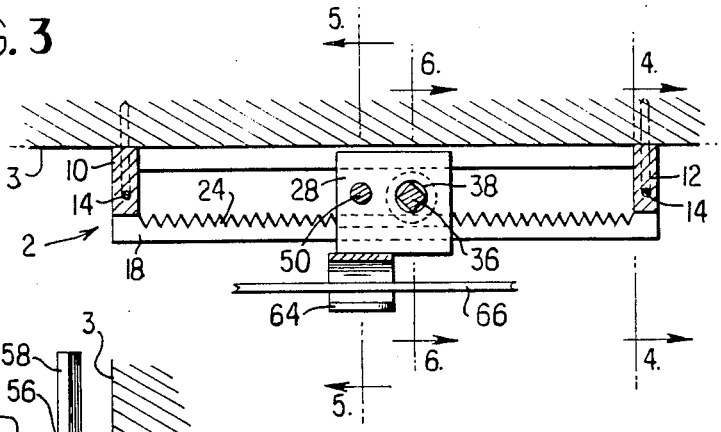
FIG. 4
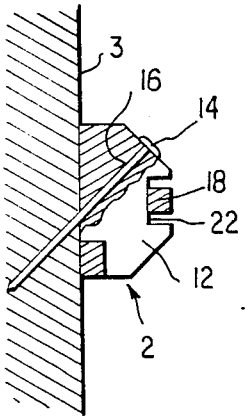
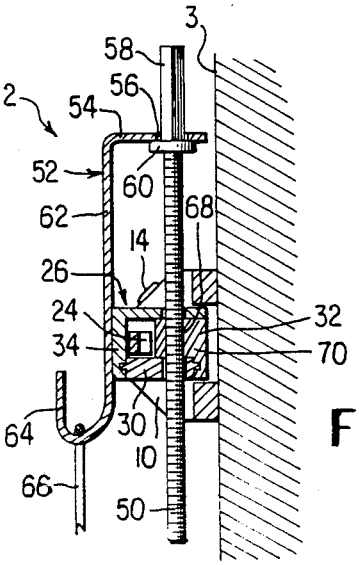
FIG. 5
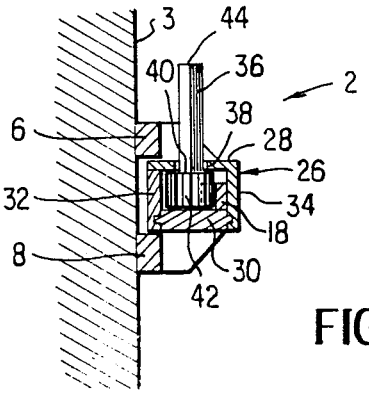
FIG. 6

ADJUSTABLE HANGER

FIELD OF THE INVENTION

The invention concerns a device for hanging an object on a wall.

BACKGROUND OF THE INVENTION

Known picture hangers are not continuously adjustable in both the horizontal and vertical directions. It is useful to be able to adjust the position of a picture both horizontally and vertically after it has been mounted on the wall, since it is often not possible to find precisely the correct position before hanging.

U.S. Pat. Nos. 2,522,901; 2,697,572; 2,723,096 and 4,611,779 each describe picture hangers which are able to be adjusted vertically. U.S. Pat. No. 2,723,096 includes three separate, alternative, horizontal positions for a vertically adjustable hook. None of the patents show a picture hook capable of being continuously adjustable in both the horizontal and vertical directions.

SUMMARY OF THE INVENTION

An adjustable device for hanging an object on a wall includes a support structure for attaching the device to a wall and means for continuously moving the object in two perpendicular directions. A vertically positioned threaded screw for vertical adjustment of the height of the object is movable horizontally on a carrier positioned on a horizontal rack and pinion device. A hook for hanging the object to be supported is engaged with the threaded screw. Thus, adjustment of the threaded screw adjusts the position of the object vertically and adjustment of the position of the carrier on the rack and pinion device adjusts the position of the object (supported by the threaded screw) horizontally.

The positions of the threaded screw and the carrier may be adjusted remotely by means of a elongated tool.

It is an object of the invention to provide a device for hanging an object on a wall in a position which may be continuously adjusted both horizontally and vertically.

BRIEF DESCRIPTION OF THE DRAWINGS

FIG. 1 is a front elevational view of a device of the invention at to a wall, in use for hanging an object.

FIG. 2 is an elevational view, partly in cross section, of an adjusting tool.

FIG. 3 is a cross-sectional view taken on line 3—3 of FIG. 1.

FIG. 4 a cross-sectional view taken on line 4—4 of FIG. 3.

FIG. 5 is a cross-sectional view taken on line 5—5 of FIG. 3.

FIG. 6 is a cross-sectional view taken on line 6—6 of FIG. 3.

DETAILED DESCRIPTION OF THE INVENTION

A device for hanging an object on a wall and remotely adjusting its position includes means for attaching the device to the wall and means for continuously moving the object, within certain limits, in both a horizontal direction and a vertical direction. When a picture or other object is hung on a wall, it is sometimes difficult to locate the picture exactly in the right place, particularly if the picture is large. The adjustable device of the invention allows the picture to be moved both horizontally and vertically, continuously and from a remote position, so that the picture is not removed during adjustment and only one set of nail holes need to be made in the wall. The device rests flat against the wall and only extends a very short distance from the wall.

With reference to FIGS. 1 to 6, in which like numerals represent like parts, FIG. 1 and FIGS. 3 to 6 show device 2 in position for use, attached to a wall surface 3. Device 2 comprises support 4 which is nailed to the wall. Support 4, includes upper bar 6 and lower bar 8 connected by end supports 10 and 12. Nails 14 each extend through a channel 16 in end supports 10 and 12, thus fastening device 2 to wall surface 3.

Center bar 18 is supported at its ends by end supports 10 and 12, particularly by surfaces 20 and 22 of end supports 10 and 12, respectively. Center bar 18 includes a rack 24 on its inner surface, facing wall surface 3. Carrier 26 rides on center bar 18.

Carrier 26 has an upper wall 28, a lower wall 30, an inner wall 32, an outer wall 34 and end walls (not shown). Upper wall 28 and front wall 34 may be integrally formed as shown in FIG. 6. Inner wall 32 may be formed in one piece with the end walls, if desired.

FIG. 6 shows the mechanism for horizontal adjustment of the position of carrier 26. Rod 36, which has a square cross section, shown in FIG. 3, enters carrier 26 through aperture 38 in upper surface 28 of the carrier. Inner end 40 of rod 36 is secured to gear or pinion 42 which is engaged with horizontal rack 24. When rod 36 is turned, pinion 42 moves along rack 24 and carrier 26, carried on the rack, continuously moves smoothly along center bar 18. FIG. 2 shows elongated tool 46 having a socket 48 at one end shaped to engage end 44 of rod 36. The tool is elongated to allow remote turning of rod 36 from above, thus moving carrier 26 from a remote position. In the example illustrated, socket 48 has a square cross-section, similar to the cross-section of rod 36. Other shapes will be apparent to one skilled in the art.

As shown in FIG. 5, threaded rod 50 supports hook 52. Hook 52 preferably includes a flat portion 54 having a hole 56 for passing over top portion 58 of threaded rod 50. Flat end 54 rests on lip 60 of threaded rod 50. Flat front portion 62 of hook 52 rests against outer wall 34 of carrier 26 and terminates in hook portion 64 which carries the object being supported, such as by means of cord 66. Top portion 58 of threaded rod 50 also has a square cross-section which may be adjusted by engagement with socket 48 of elongated tool 46. Threaded rod 50 cooperates with threaded aperture 68 which passes through block 70 attached to inner wall 32 of carrier 26.

In use, device 2 is mounted on wall surface 3 by means of nails 14. Hook 52 is supported on lip 60 of threaded rod 50 and the object to be supported is hung by cord 66 or otherwise appropriately supported on hook 52. To adjust the position of the object, elongated tool 46 is engaged over upper end 58 of threaded rod 50 to make vertical adjustments in the position of the object. Elongated tool 46 is engaged over upper end 44 of rod 36 to make horizontal adjustments of the position of the object by moving carrier 26 horizontally along the rack and pinion mechanism. Thus, the position of the object may be adjusted continuously in both the vertical and horizontal directions once it has been positioned approximately in the desired location. Since, in use, the top ends of rods 36 and 50 are generally concealed by the hanging object, tool 46 is elongated to allow rods 36 and 50 to be turned from a remote position without disturbing the hanging object. The object may be moved horizontally the distance between end supports 10 and 12, and may be moved vertically the length of threaded rod 50.

It will be apparent to one skilled in the art that references to horizontal and vertical directions are nonlimiting, and may be interchanged or varied to other appropriate directions, as needed.

While the invention has been described above with respect to certain embodiments thereof, it will be appreciated that variations and modifications may be made without departing from the spirit and scope of the invention.

What is claimed is:

1. An adjustable device for hanging an object on a wall comprises:

means for attaching the device to the wall;

adjustable means for continuously moving the object in a first direction engaged with the means for attaching the device to the wall;

carrier means for engaging the adjustable means for continuously moving the object in the first direction;

adjustable means engaged with the carrier means for continuously moving the object in a second direction perpendicular to the first direction; and means for attaching an object to the device engaged with the adjustable means for continuously moving the object in the second direction;

whereby an object hanging on a wall may be moved by adjusting one or both of the adjustable means without removing the object from the wall.

2. A device of claim 1 wherein the means for continuously moving the object in the first direction comprises gear means.

3. A device of claim 2 wherein the means for continuously moving the object in the second direction comprises a threaded rod.

4. A device of claim 3 further comprising elongated means for remotely adjusting the means for moving the object in the first direction and the means for moving the object in the second direction.

5. An adjustable device for hanging an object on a wall comprising:

means for attaching the device to the wall;

gear means for continuously moving the object in a first direction engaged with the means for attaching the device to the wall;

carrier means engaged with the gear means for moving in the first direction by the gear means;

threaded means engaged with the carrier means for continuously moving the object in a second direction perpendicular to the first direction; and hook means for carrying the object engaged with the threaded means.

6. A device of claim 5 wherein the gear means comprises rack and pinion means.

7. A device of claim 5 further comprising elongated means for adjusting the rack and pinion means and the threaded means.

8. An adjustable hanging device comprising:

support means;

carrier means mounted on said support means;

gear means operatively connecting said carrier means to said support means for movement of said carrier means in a first selected direction;

threaded means operatively connected to said carrier means for movement of said threaded means in a second selected direction; and object hanging means engaged with said threaded means for movement in said second selected direction.

9. The device of claim 8 further comprising adjusting means for engagement with said gear means for moving said gear means in said first direction.

10. The device of claim 8 further comprising adjusting means for engagement with said threaded means for moving said threaded means in said second direction.

11. The device of claim 8 wherein the gear means comprises rack and pinion means.

12. The device of claim 8 wherein the threaded means comprises an elongated rod having lip means adjacent one end thereof, and wherein said object hanging means is carried by said lip means.

13. The device of claim 12 wherein said object hanging means is elongated and has a flat end portion fitting over said one end of said rod and carried by said lip means on said rod.

14. The device of claim 13 further comprising adjusting means for engagement with said gear means for moving said gear means in said first direction and for engagement with said threaded means for moving said threaded means in said second direction.

15. The device of claim 14 wherein said gear means is provided with operating means including an elongated rod of non-round cross-section and said threaded means is provided with operating means including an elongated end portion of non-round cross-section; said adjusting means including socket means of non-round cross section shaped to receive said rod and said end portion; said elongated rod and said elongated end portion being located close to each other whereby said adjusting means may be easily and quickly applied to each of said operating means to move said object hanging means to a selected position.

* * * * *